US007213412B2

(12) United States Patent
Kent et al.

(10) Patent No.: US 7,213,412 B2
(45) Date of Patent: May 8, 2007

(54) CONDENSER WITH INTEGRAL RECEIVER AND CAPABLE OF UPFLOW OPERATION

(75) Inventors: Scott Edward Kent, Albion, NY (US); Lawrence P. Scherer, Lockport, NY (US); David A. Southwick, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 197 days.

(21) Appl. No.: 11/116,982

(22) Filed: Apr. 28, 2005

(65) Prior Publication Data

US 2006/0242993 A1 Nov. 2, 2006

(51) Int. Cl.
*F25B 39/04* (2006.01)

(52) U.S. Cl. ..... 62/509

(58) Field of Classification Search ..... 62/474, 62/498, 509, 512

See application file for complete search history.

(56) References Cited

U.S. PATENT DOCUMENTS

| | | | | |
|---|---|---|---|---|
| 5,713,217 | A * | 2/1998 | Baba | 62/509 |
| 5,813,249 | A * | 9/1998 | Matsuo et al. | 62/509 |
| 6,267,173 | B1 * | 7/2001 | Hu et al. | 165/132 |
| 6,397,627 | B1 | 6/2002 | Aki et al. | 62/509 |
| 6,427,480 | B1 * | 8/2002 | Ito et al. | 62/509 |

* cited by examiner

*Primary Examiner*—Melvin Jones
(74) *Attorney, Agent, or Firm*—Patrick M. Griffin

(57) ABSTRACT

A condenser for an air conditioning system includes a receiver integrally formed with a second, or return, header which is in fluid communication with a second, or sub-cooling, group of tubes. A conduit extends between entry and discharge ends both of which are completely enclosed within the interior of the receiver. The conduit transports a refrigerant fluid in an upflow direction within the interior of the receiver and through a second fluid port located adjacent the discharge end of the conduit for directing the fluid into and through the return header to the sub-cooling group of tubes.

19 Claims, 9 Drawing Sheets

CONDENSER WITH INTEGRAL RECEIVER AND CAPABLE OF UPFLOW OPERATION

BACKGROUND OF THE INVENTION

1. Field of the Invention

This invention relates to air conditioning systems. More specifically, the invention relates to an integral receiver assembly for a sub-cooled condenser.

2. Description of the Related Art

Condensers designed for upflow operation and which utilize integral receivers are well known in the art. Such condensers often utilize receivers which are connected to, or otherwise integrally formed with, the return header of the condenser. An example of such a condenser is disclosed in U.S. Pat. No. 6,397,627 ("Aki et al."). The Aki et al. condenser includes a plurality of tubes through which a refrigerant fluid flows between initial and return header tanks. The tubes are divided into an upstream group within which the fluid is condensed from a gas to a liquid, and a downstream, or "sub-cooling" group within which the condensed fluid is further cooled prior to exiting the condenser. The sub-cooling group is disposed above the upstream group within the core. The refrigerant fluid flows from the initial header through the uptream group of tubes into the return header and then flows through the sub-cooling tubes prior to exiting the condenser.

The receiver utilized in the Aki et al. condenser is integrally formed with the return header. Designed to separate any gaseous components remaining in the refrigerant from the liquid components thereof before the remaining fluid flows back into the return header and then into the sub-cooling group of tubes, the Aki et al. receiver extends from a closed base positioned adjacent to the downstream group of tubes to a closed cover located adjacent the sub-cooling group. An elongate communications pipe interconnects the cover of the receiver with the return header. The pipe extends from a lower portion to an upper portion. The lower portion is disposed completely within the interior of the receiver and has an open end which is positioned adjacent to the base. The upper portion extends from the interior of the receiver through the cover to the exterior, and is connected directly to the return tank. Condensed fluid flows from the downstream group of tubes into the return tank, and passes into the receiver through a single communications hole located in the wall between the return header and the receiver.

The communication hole within the Aki et al. receiver is disposed higher than the open end of the pipe, which prevents the gaseous components in the condensed refrigerant from entering the open end. Once inside the receiver, the gaseous components are effectively isolated within the interior. The liquid components are directed to flow through the open end upwardly through the pipe and into the return tank before being introduced to the sub-cooling group of tubes.

The Aki et al. receiver effectively separates gaseous components from a condensed fluid and successfully transports the remaining liquid components in an "upflow" direction through the receiver to the sub-cooling area of a condenser. However, extending the communications pipe through the receiver cover and attaching the upper portion directly to the return tank increases the number of exterior joints through which the condensed fluid may leak. This compromises the structural integrity of the receiver and reduces the thermal efficiency of the condenser.

BRIEF SUMMARY OF THE INVENTION AND ADVANTAGES

The subject invention provides a condenser for an air conditioning system. The condenser includes first and second headers, with a receiver that extends parallel to the second header. A first group of tubes extends between the first and second headers and is in fluid communication therewith for permitting a fluid to flow between the headers through the first group of tubes. A second group of tubes also extends between the first and second headers. The second group is likewise in fluid communication with the headers, which permits the fluid to flow between the headers through the second group. A header separator is in each of the headers and divides the header into a first header chamber in fluid communication with the first group and a second header chamber in fluid communication with the second group.

A first fluid port is between the first header chamber of the second header and the receiver for directing the fluid to flow from the first tube group and the first header chamber to the receiver. A conduit extends within the receiver between an entry end and a discharge end. The discharge end is disposed within the receiver. A receiver separator extends between the conduit and the receiver to establish a receiver chamber, which surrounds the discharge end of the conduit for directing the fluid to flow through the conduit from the entry end to the discharge end and into the chamber. A second fluid port is located between the receiver and the second header chamber of the second header. The second fluid port is disposed adjacent the discharge end for directing the fluid through the receiver chamber to the second header chamber and the second group of tubes.

The subject invention overcomes the limitations of the art by providing a condenser with an integrally formed receiver that utilizes a conduit which is completely enclosed within the interior of the receiver. Disposing the entire conduit inside the receiver prevents additional external leak paths from being created by avoiding the introduction of additional welded or brazed external parts to the condenser. This reduces manufacturing costs, promotes ease of assembly, and reduces operating costs to the end user.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
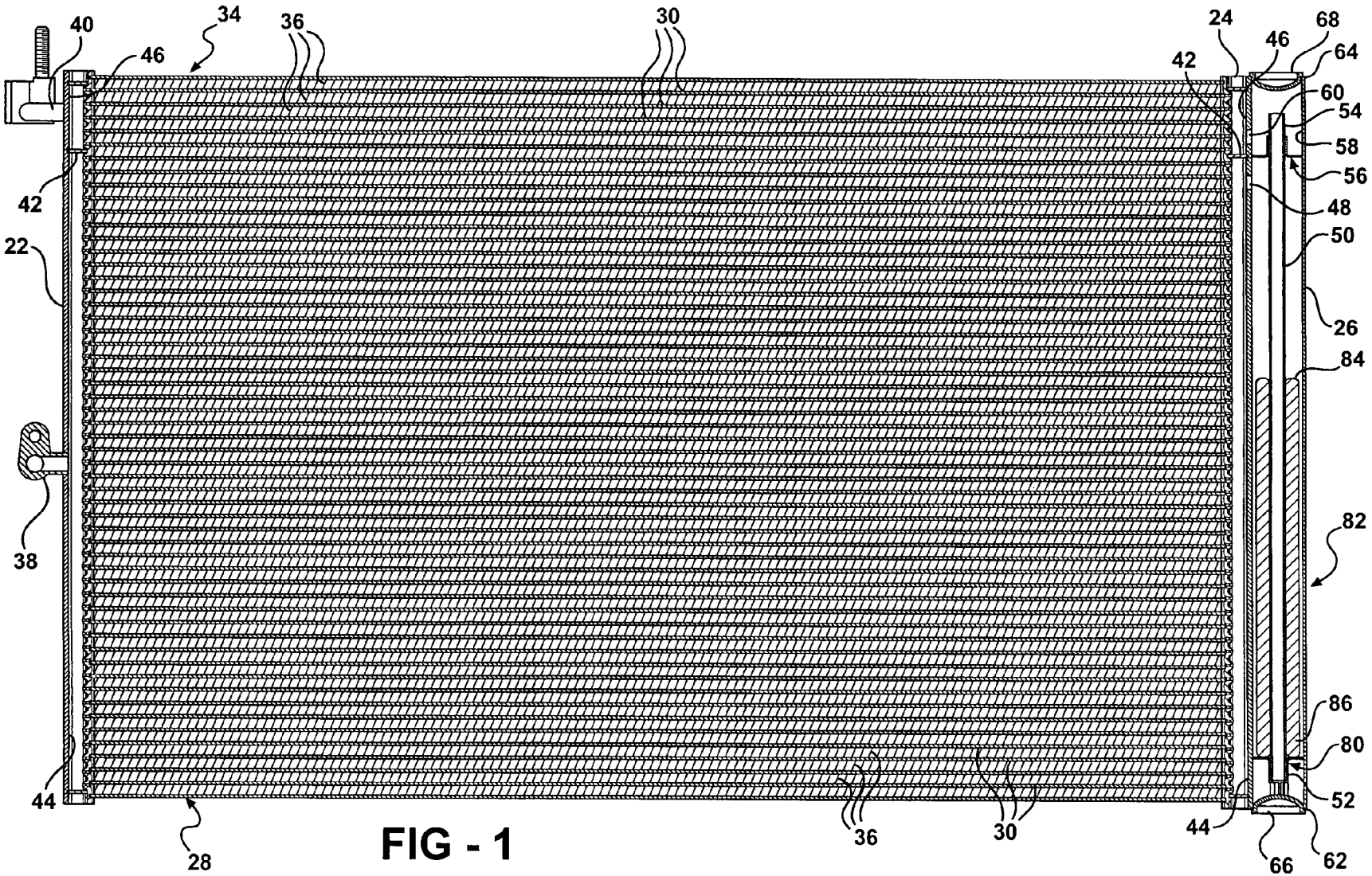
FIG. 1 is a cross-sectional view of a condenser according to one embodiment of the present invention.
Figure 2:
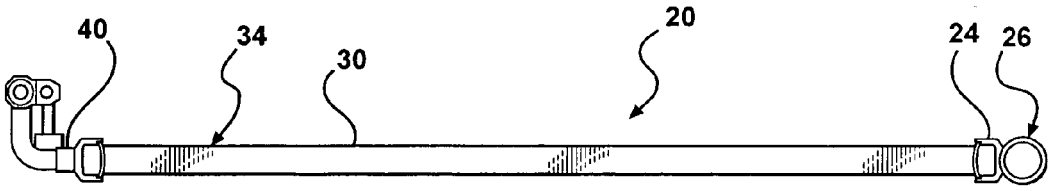
FIG. 2 is a top planar view of the condenser according to FIG. 1.
Figure 3:
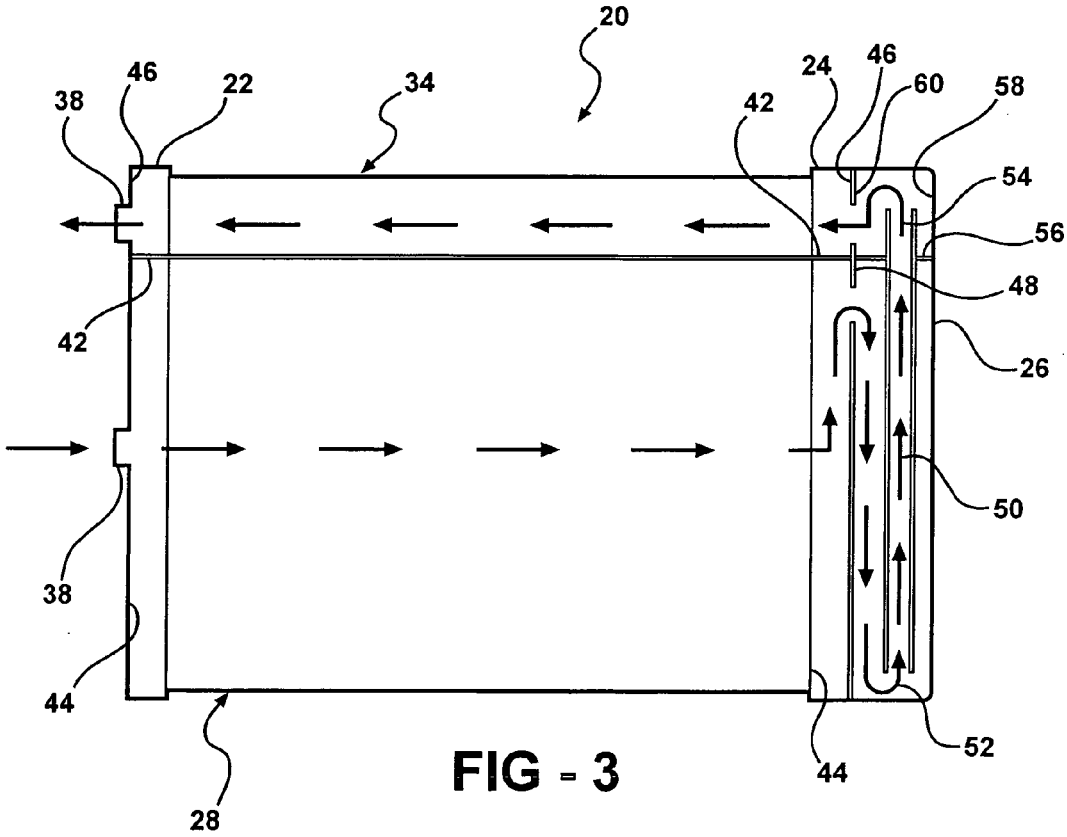
FIG. 3 is a schematic view of the condenser according to FIG. 1.

Referring now to the Figures, wherein like numerals indicate like or corresponding parts throughout the several views, a condenser for an air conditioning system is generally shown at 20 in FIGS. 1 through 3. The condenser 20 includes a first header 22, a second header 24, and a receiver 26. The receiver 26 extends parallel to the second header 24.

As is best shown in FIG. 3, a first group 28 of tubes 30 extends between the first and second headers 22, 24. The tubes 30 in the first group 28 are in fluid communication with the headers 22, 24, which permits a fluid 32 to flow between the headers 22, 24 and through the first group 28. A second group 34 of tubes 30 also extends between the first and second headers 22, 24. Like the tubes 30 in the first group 28, the tubes 30 in the second group 34 are in fluid communication with the headers 22, 24, which similarly permits the fluid 32 to flow between the headers 22, 24 through the second group 34. As is shown in FIG. 1, a plurality of corrugated fins 36 are interposed between the tubes 30.

The first header 22 also includes an inlet 38 and an outlet 40. Referring again to FIG. 3, the fluid 32 enters the first header 22, passes through the first group 28 of tubes 30 into the second header 24, and flows through the receiver 26 back into the second header 24. The fluid 32 then passes from the second header 24 through the second group 34 of tubes 30, and exits the condenser 20 through the outlet 40.

A header separator 42 is disposed in each of the headers 22, 24. Each separator 42 divides a selected one of the headers 22, 24 into first and second header chambers 44, 46. The first header chamber 44 is in fluid communication with the first group 28 of tubes 30, and the second header chamber 46 is in fluid communication with the second group 34. A first fluid port 48 is located between the receiver 26 and the first header chamber 44 of the second header 24, which directs the fluid 32 to flow from the first group 28 of tubes 30 and the first header chamber 44 to the receiver 26.

Figure 5:
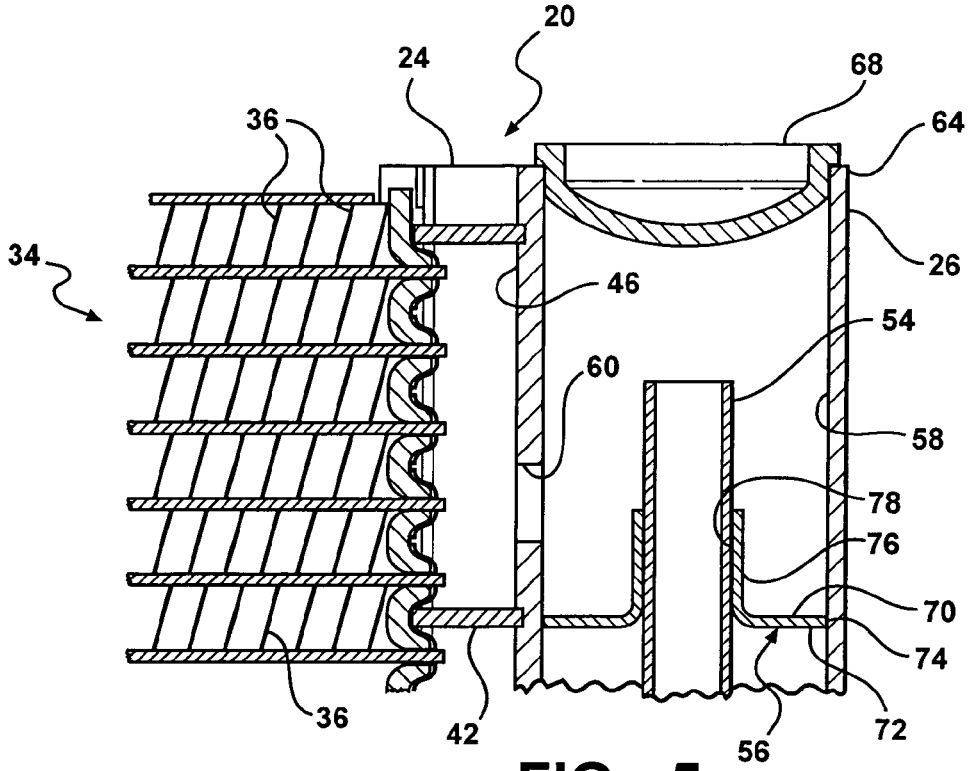
FIG. 5 is a fragmentary view of the condenser shown in FIG. 1.

A conduit 50 extends within the receiver 26. The conduit 50 has an entry end 52, and extends to a discharge end 54 which is disposed within the receiver 26. A receiver separator 56 extends between the conduit 44 and the receiver 26. As is best shown in FIG. 5, the receiver separator 56 establishes a receiver chamber 58 that surrounds the discharge end 54, whereby the fluid 32 is directed to flow through the conduit 50 from the entry end 52 to the discharge end 54 and into the receiver chamber 58.

Referring again to FIG. 1, a second fluid port 60 is located between the receiver 26 and the second header chamber 46 of the second header 24. Positioned adjacent the discharge end 54 of the conduit 50, the second fluid port 60 directs the fluid 32 through the receiver chamber 58 to the second header chamber 46, where the fluid 32 then flows to the second group 34 of tubes 30.

Figure 4:
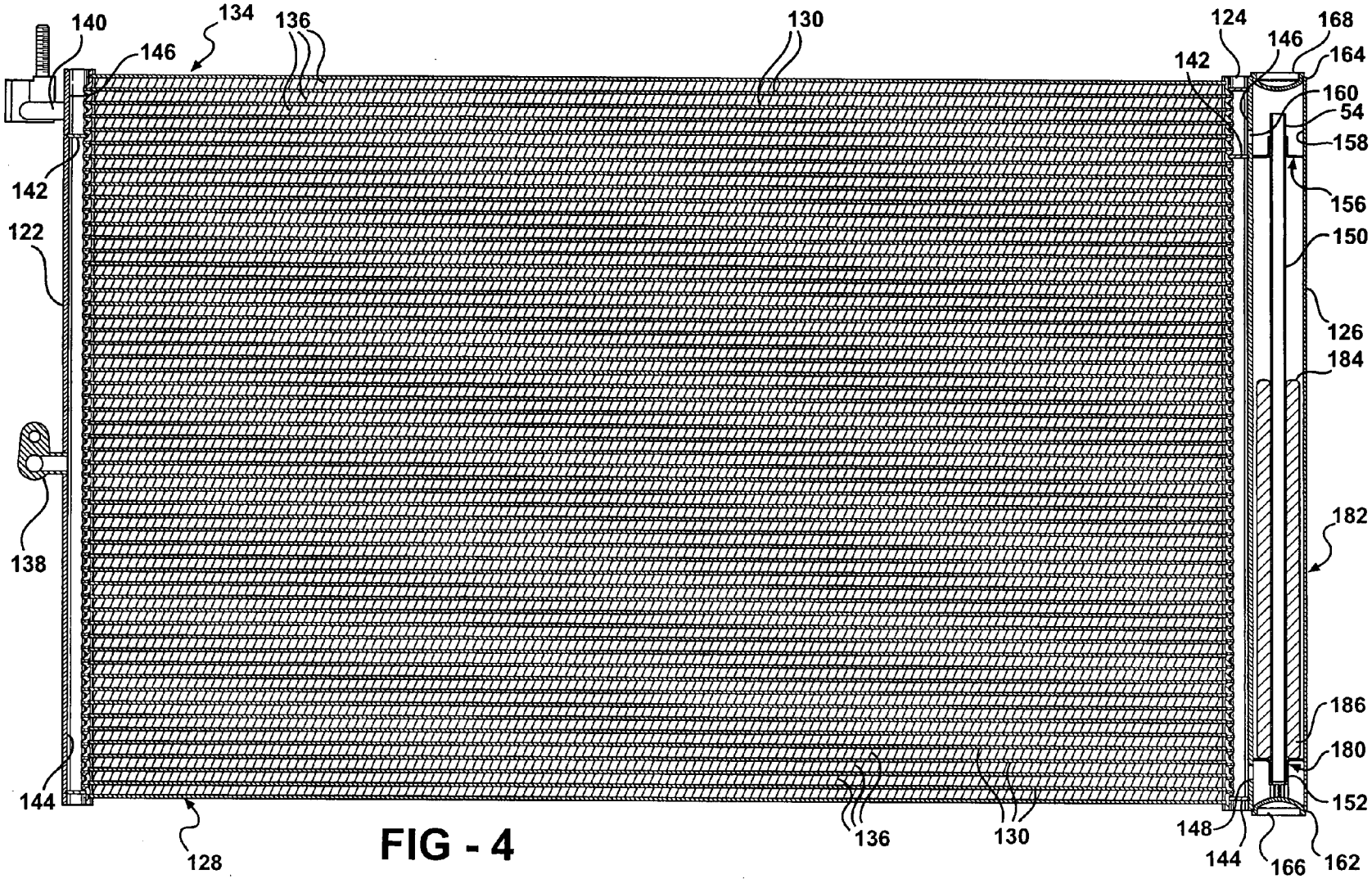
FIG. 4 is a cross-sectional view of a condenser according to an alternative embodiment of the invention.

As is shown in FIG. 1, the first fluid port 48 is disposed adjacent the receiver separator 56. However, as is the case in the alternative embodiment of the condenser 120 shown in FIG. 4, the first fluid port 148 may alternatively be disposed adjacent the entry end 152 of the conduit 150. With the exception of the location of first fluid port 148, the condenser 120 shown in FIG. 4 is fabricated from the same materials and utilizes the same components as the condenser 20. With respect to both embodiments of the condenser 20, 120, regardless of the proximity of the first fluid port 48, 148 to the receiver separator 56, 156, the entry end 52, 152 of the conduit 50, 150 extends below the first fluid port 48, 148. This ensures that any gaseous components remaining in the fluid 32, 132 remain within the receiver 26, 126 below the receiver separator 56, 156 rather than flowing with the liquid components of the condensed fluid 32, 132 into the entry end 46, 146 and through the conduit 50, 150.

Referring again to FIG. 1 and using the condenser 20 as a representative example, the receiver 26 extends between first and second closed ends 62, 64, with the conduit 50 disposed totally within the receiver 26. Although the ends 62, 64 may be closed by brazing or by utilizing any other suitable processes or components, a first end cap 66 covers the first closed end 62. This encloses the discharge end 54 of the conduit 50 within the receiver 26. A second end cap 68 similarly covers the second closed end 64 to enclose the entry end 52 of the conduit 50 within the receiver 26.

Referring now to FIG. 5, the receiver separator 56 includes a disc 70 which extends radially from the conduit 50 to an outer peripheral edge 72. The outer peripheral edge 72 is disposed against the interior of the receiver 26. In addition, an annular lip 74 extends axially from the outer peripheral edge 72. The lip 74 is in sealing engagement with the receiver 26, which prevents any gaseous components of the fluid 32 from entering the receiver chamber 58. The disc 70 also features a neck 76 with a cylindrical sidewall 78 that engages the conduit 50 to support the conduit 50 within the receiver 26.

Figure 6:
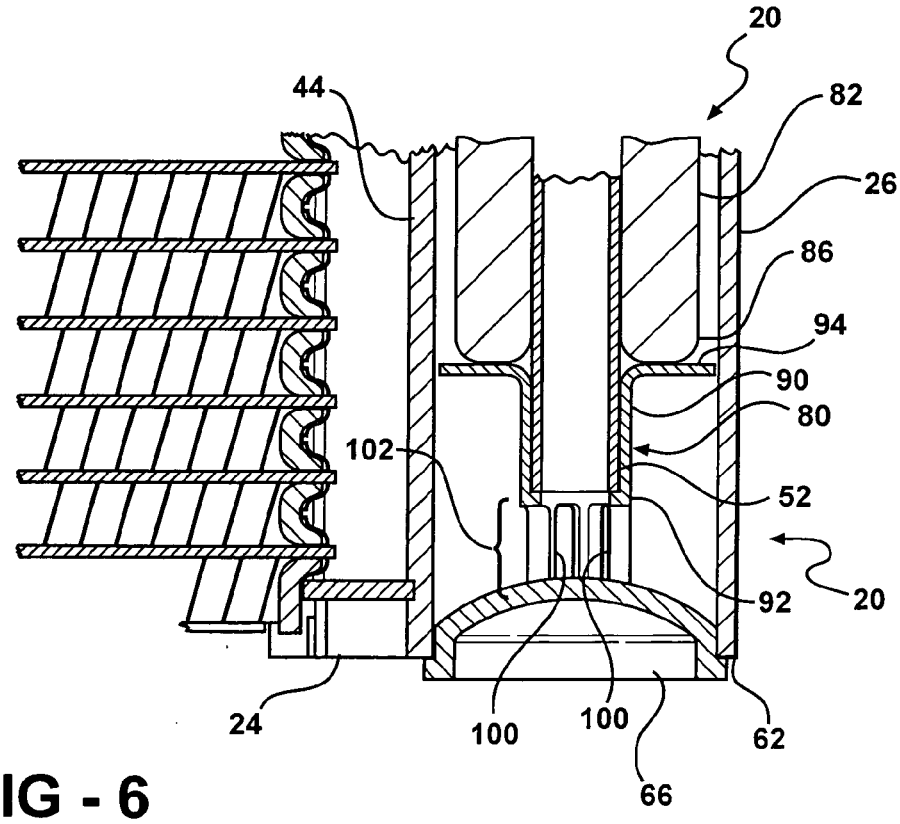
FIG. 6 is another fragmentary view of the condenser shown in FIG. 1.
Figure 7:
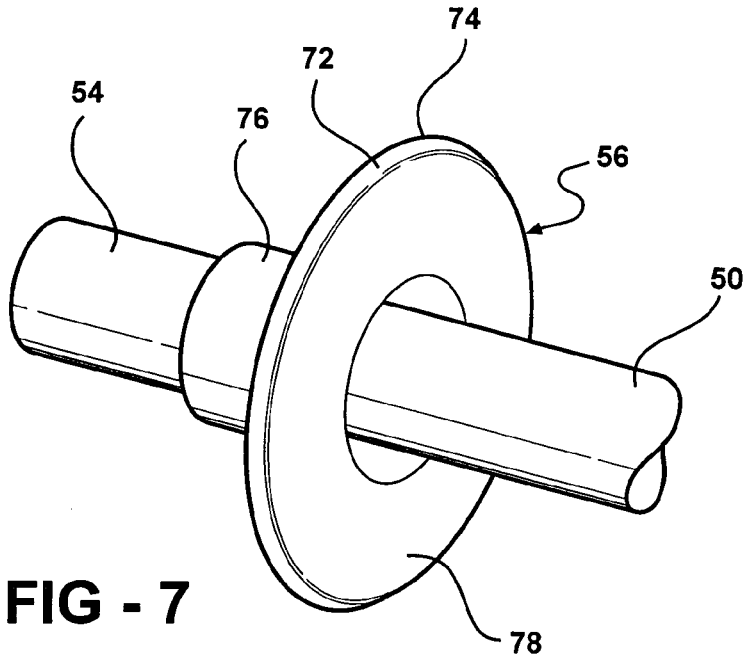
FIG. 7 is a fragmentary perspective view of the conduit and receiver separator of the condenser shown in FIG. 1.

Referring now to FIG. 6, the condenser 20 also includes a support member 80 that extends radially between the conduit 50 and the receiver 26. Like the receiver separator 56, the support member 80 supports the conduit 50 within the receiver 26. A desiccant 82 is also supported by the support member 80. The desiccant 82 dehydrates the fluid 32. As is shown in FIG. 1, the desiccant 82 is disposed about the conduit 50 and extends from an upper portion 84 adjacent the receiver separator 56 to a lower portion 86. As is best shown in FIG. 6, the lower portion 86 abuts the support member 80, which prevents the desiccant 82 from settling against the first closed end 62 of the receiver 26 and blocking the first fluid port 48. Although any suitable type of desiccant may be used, the desiccant 82 is a conventional, annular desiccant cartridge.

Figure 8:
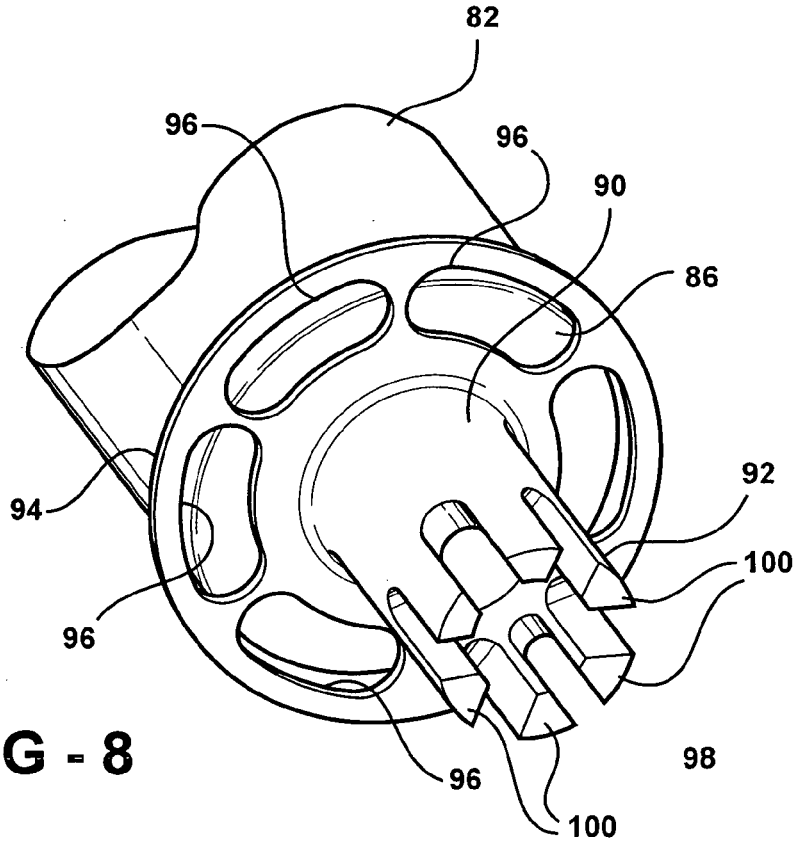
FIG. 8 is a fragmentary perspective view of the support member and desiccant of the condenser shown in FIG. 1.
Figure 9:
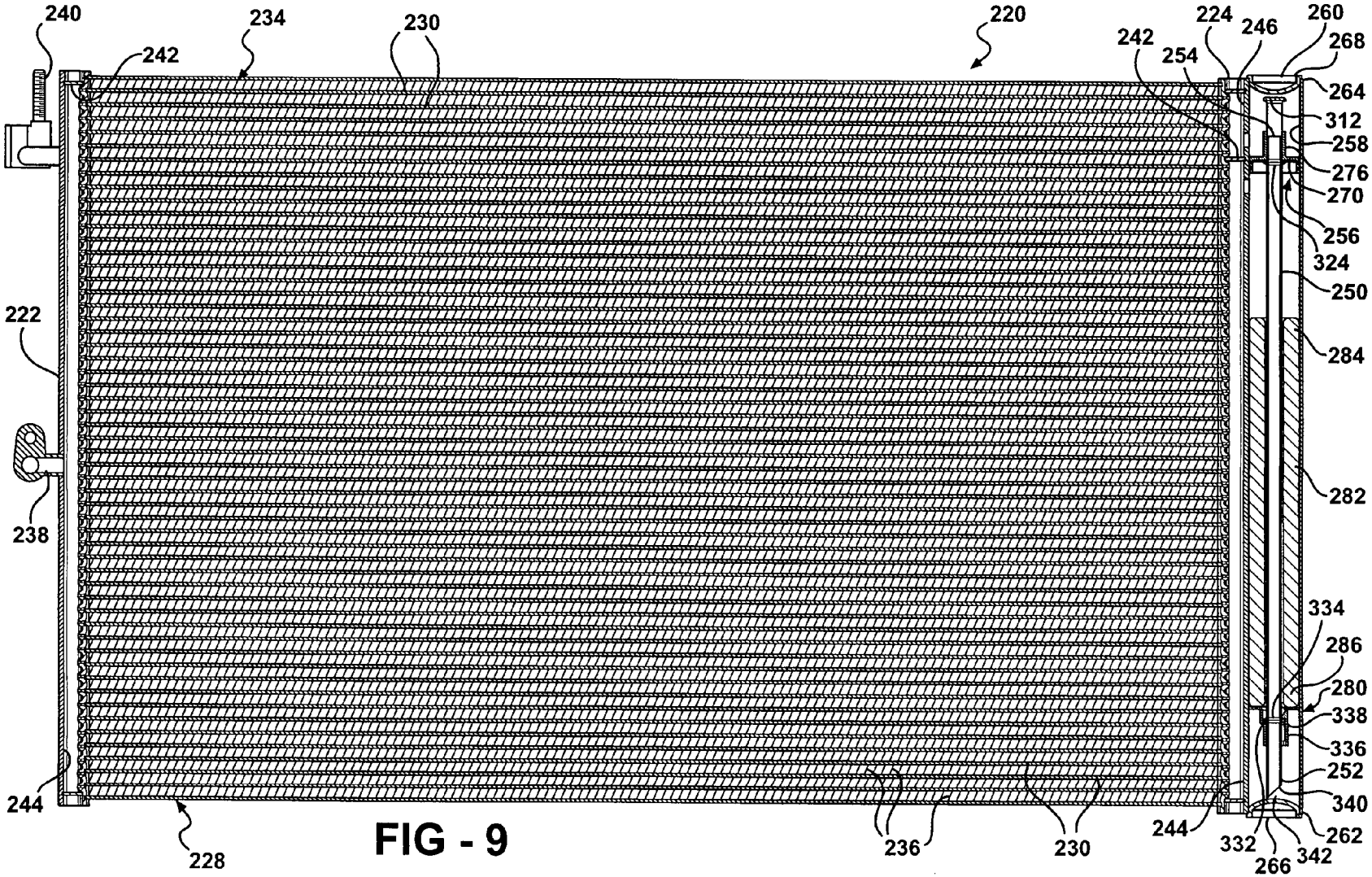
FIG. 9 is a cross-sectional view of a condenser according to another alternative embodiment of the invention.

Referring now to FIG. 8, the components of the support member 80 are specifically designed not only to maintain the desiccant 82 in a stationary position above the first fluid port 48, but also to provide stabilizing support to the conduit 50 while simultaneously permitting the fluid 32 to flow freely from the first fluid port 48 into the entry end 52. The support member 80 has a tubular base 88 that extends from an upper edge 90 to a lower edge 92. The base 88 defines a bore 94 which is disposed about the entry end 52 of the conduit 50. A flange 96 extends radially outwardly from the upper edge 90 and includes spaced openings 98. The fluid 32 is exposed to the desiccant 82 by flowing around the flange 96 and through the openings 98.

The support member 80 also includes a plurality of spaced projections 100 that extend from the lower edge 92 of the tubular base 88. Referring again to FIG. 5, the projections 100 are disposed against the first closed end 62 of the receiver 26 to define a space 102 between the entry end 52 of the conduit 50 and the first closed end 62, which in turn permits the fluid 32 to flow freely through the receiver 26 from the first fluid port 48 into the entry end 52.

Referring now to FIGS. 9 through 16, a condenser 220 according to an alternative embodiment of the invention is shown. With the exception of the components disposed within the receiver 226, the condenser 220 is fabricated out of the same materials and utilizes the same components as the condenser 20.

Figure 12:
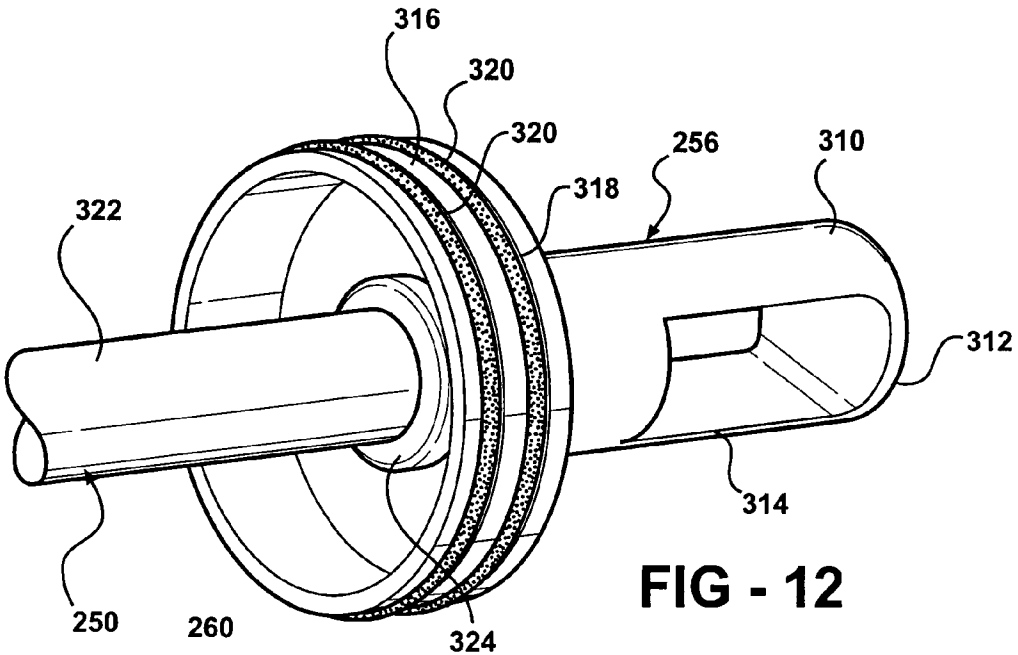
FIG. 12 is a fragmentary perspective view of the receiver separator of the condenser shown in FIG. 10.

The receiver separator 256 of the condenser 220 differs from the receiver separator 56 of the condenser 20 in that the cylindrical sidewall 278 of the receiver separator 256 extends to an upper end FIG. 12. A cap 312 covers the upper end 310, which causes the discharge end 254 of the conduit 250 to be disposed completely within the neck 276. In addition, the cylindrical sidewall 278 includes at least one, or as is disclosed in FIG. 12, two openings 314. Each opening 314 is positioned intermediate the cap 312 and the discharge end 254 of the conduit 250. The fluid is directed from the discharge end 254 through the openings 314 and into the receiver chamber 258.

Figure 10:
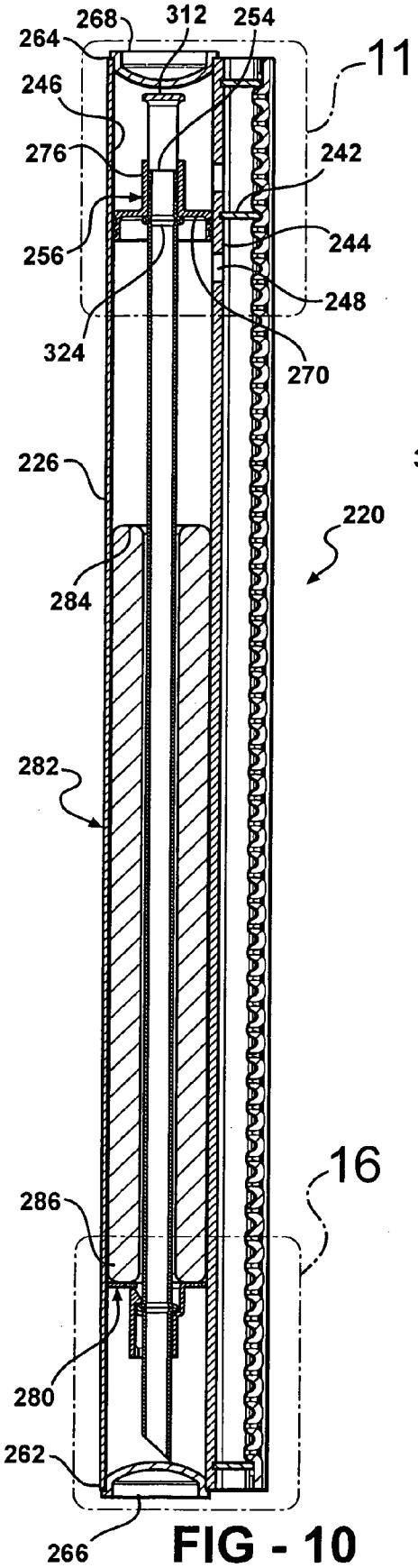
FIG. 10 is a fragmentary view illustrating the receiver of the condenser shown in FIG. 9.
Figure 11:
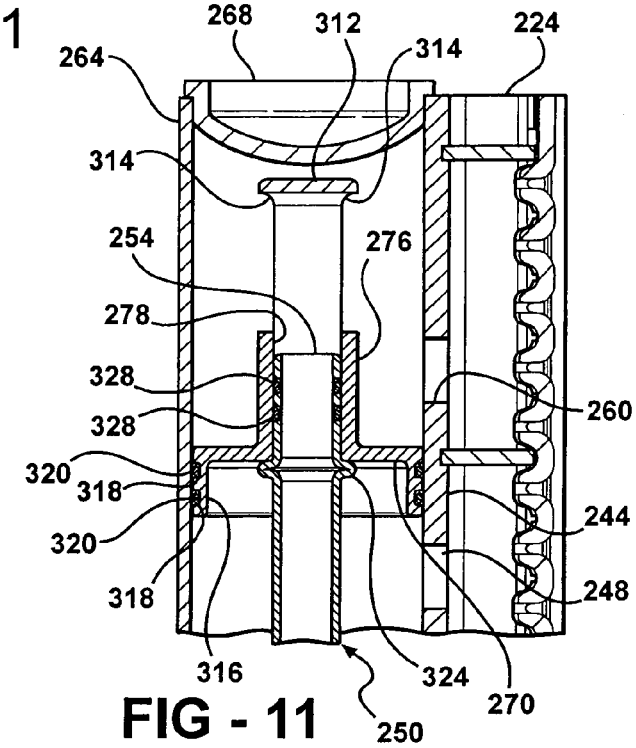
FIG. 11 is a fragmentary view of the receiver shown in FIG. 10.

The receiver separator 256 also includes a cylindrical outer wall 316 that extends from the outer peripheral edge 272 of the disc 270. As is shown in FIGS. 10 and 11, the cylindrical outer wall 316 is disposed against the interior of the receiver 226, and includes an annular groove 318 into which an O-ring 320 is received for creating a fluid seal against the interior of the receiver 226. An identically-shaped annular groove 318 is spaced parallel to the annular groove 318. Another O-ring 320 is received within the identically-shaped groove 318, which enhances the fluid seal.

Figure 13:
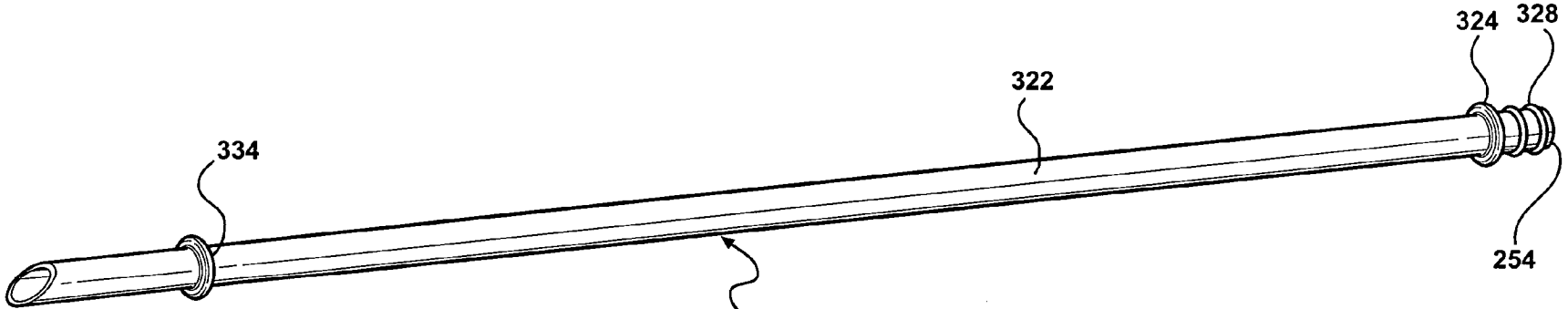
FIG. 13 is a perspective view of the conduit of the condenser shown in FIG. 9.

Referring now to FIG. 13, the sealing capability of the receiver separator 256 is further enhanced by modifications to the conduit 250. Specifically, the conduit 250 has an exterior surface 322 from which an annular rib 324 extends adjacent the discharge end 254. As is shown in FIG. 11, the rib 324 is positioned in abutting engagement with the disc 270, which in turn orients the discharge end 254 within the receiver chamber 256. In addition, the exterior surface 322 has at least one, or as disclosed two, second annular grooves 326 into which second O-rings 328 are received. The second grooves 326 and second O-rings 328 create a fluid seal against the interior of the cylindrical sidewall 278 of the neck 276.

Figure 16:
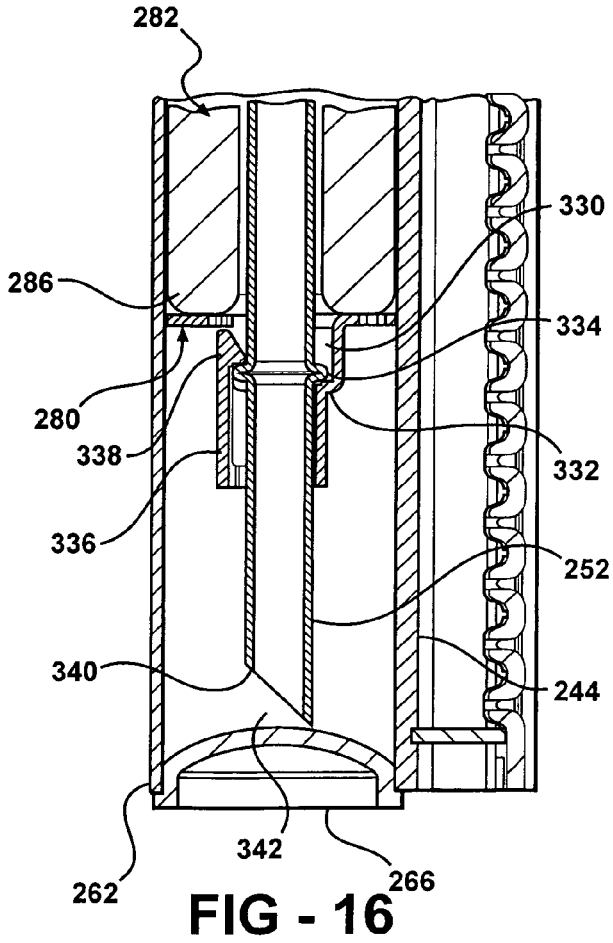
FIG. 16 is a fragmentary cross-sectional view of the conduit, desiccant and support member assembled within the condenser shown in FIG. 9.
Figure 14:
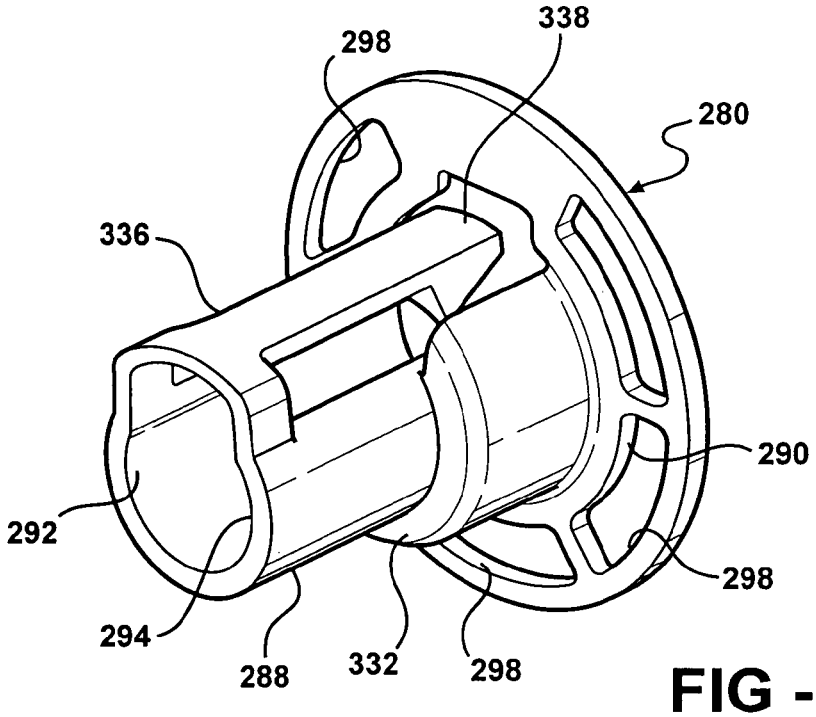
FIG. 14 is a perspective view of the support member of the condenser shown in FIG. 9.
Figure 15:
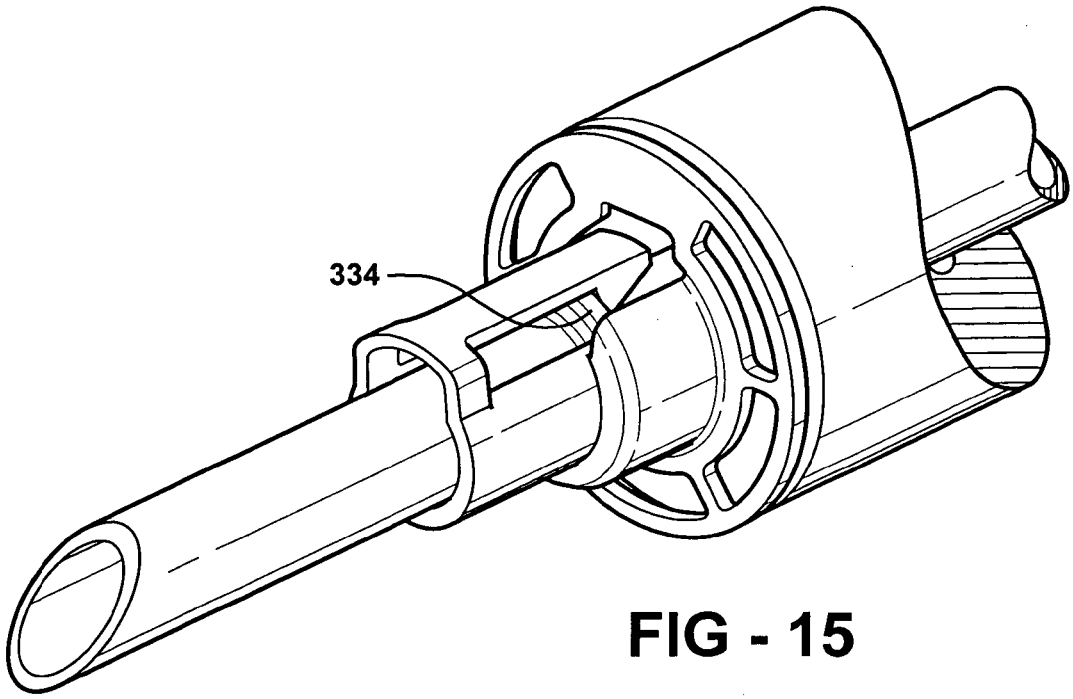
FIG. 15 is a perspective view of the conduit and desiccant assembled with the support member shown in FIG. 14.

Referring now to FIGS. 14 through 16, the support member 280 differs from the support member 80 of the condenser 20 in that the tubular base 288 includes an interior sidewall 330 defining a shoulder 332. The shoulder 332 extends radially inwardly into the bore 294 and engages the conduit 250.

The conduit 250 also includes a second annular rib 334 that extends from the exterior surface 322 adjacent the entry end 252. The second annular rib 334 is in abutting engagement with the shoulder 332, which orients the entry end 252 within the interior of the receiver 226.

The support member 280 also differs from the support member 80 by having a detent 336 that extends resiliently from the tubular base 288 to a distal end 338. The distal end 338 engages the second annular rib 334 to maintain the second annular rib 324 disposed against the shoulder 332. As is shown in FIGS. 15 and 16, the entry end 252 of the conduit 250 extends through the bore 298 to a beveled edge 340 which is disposed adjacent the second closed end 264 of the second header 224. This defines a space 342 between the beveled edge 340 and the second closed end 264 for permitting the fluid to flow into the entry end 252.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A condenser for an air conditioning system comprising;

a first header, a second header, a receiver extending parallel to said second header, a first group of tubes extending between said first and second headers, in fluid communication with said headers for permitting a fluid to flow between said headers, through said first group of tubes, a second group of tubes extending between said first and second headers in fluid communication with said headers for permitting the fluid to flow between said headers through said second group of tubes, a header separator in each of said headers for dividing each of said headers into a first header chamber in fluid communication with said first group and a second header chamber in fluid communication with said second group, a first fluid port between said first header chamber of said second header and said receiver for directing the fluid to flow from said first group of tubes and said second header to said receiver, a conduit extending within said receiver and having an entry end and extending to a discharge end disposed within said receiver, a receiver separator extending between said conduit and said receiver for establishing a receiver chamber surrounding said discharge end of said conduit for directing the fluid to flow through said conduit from said entry end to said discharge end and into said receiver chamber, and a second fluid port between said second header chamber of said second header and said receiver adjacent said discharge end for directing the fluid through said receiver chamber to said second header chamber and to said second group of tubes.

2. A condenser as recited in claim 1 wherein said receiver extends between first and second closed ends with said conduit disposed totally within said receiver.

3. A condenser as recited in claim 2 wherein said receiver separator comprises a disc extending radially from said conduit to an outer peripheral edge disposed against the interior of said receiver for preventing the fluid from flowing into said receiver chamber.

4. A condenser as recited in claim 3 wherein said disc includes a neck having a cylindrical sidewall engaging said conduit.

5. A condenser as recited in claim 3 wherein said disc includes an annular lip extending axially from said outer peripheral edge in sealing engagement with said receiver.

6. A condenser as recited in claim 4 wherein said cylindrical sidewall extends to an upper end with a cap covering said upper end with said discharge end of said conduit disposed completely within said neck.

7. A condenser as recited in claim 6 wherein said cylindrical sidewall includes at least one opening intermediate said discharge end and said cap for directing the fluid from said discharge end and said neck to said receiver chamber.

8. A condenser as recited in claim 7 wherein said receiver separator further comprises a cylindrical outer wall extending from said outer peripheral edge of said disc and disposed against the interior of said receiver.

9. A condenser as recited in claim 8 wherein said cylindrical outer wall includes an annular groove into which an O-ring is received for creating a fluid seal against the interior of said receiver.

10. A condenser as recited in claim 9 wherein said conduit includes an exterior surface having a second annular groove into which a second O-ring is received for creating a fluid seal against the interior of said cylindrical sidewall of said neck.

11. A condenser as recited in claim 4 and including a support member extending radially between said conduit and said receiver for supporting said conduit within said receiver.

12. A condenser as recited in claim 11 wherein said support member comprises a tubular base extending from an upper edge to a lower edge and defining a bore disposed about said entry end of said conduit.

13. A condenser as recited in claim 12 wherein said support member further comprises a flange extending radially outwardly from said upper edge of said tubular base.

14. A condenser as recited in claim 13 wherein said support member further comprises a plurality of spaced projections extending from said lower edge of said tubular base and disposed against said second closed end of said receiver to define a space between said entry end of said conduit and said second closed end for permitting the fluid to flow from said receiver into said entry end.

15. A condenser as recited in claim 12 wherein said conduit includes an exterior surface with an annular rib extending from said exterior surface adjacent said discharge end and in abutting engagement with said receiver separator for orienting said discharge end within said receiver chamber.

16. A condenser as recited in claim 15 wherein said tubular base includes an interior sidewall defining a shoulder extending radially inwardly and engaging said conduit.

17. A condenser as recited in claim 16 wherein said conduit includes a second annular rib extending from said exterior surface in abutting engagement with said shoulder for orienting said entry end within the interior of said receiver.

18. A condenser as recited in claim 17 wherein said support member further comprises a detent extending resiliently from said tubular base to a distal end engaging said second annular rib for maintaining said second annular rib disposed against said shoulder.

19. A condenser as recited in claim 15 wherein said entry end of said conduit extends to a beveled edge disposed adjacent said first closed end of said receiver to define a space between said beveled edge and said first closed end for permitting the fluid to flow into said entry end.

* * * * *